US010258818B2

(12) United States Patent
Wilkinson

(10) Patent No.: US 10,258,818 B2
(45) Date of Patent: Apr. 16, 2019

(54) MULTI-AXIAL PIVOTING ANCHOR

(71) Applicant: GYM RAX INTERNATIONAL, INC., Santa Monica, CA (US)

(72) Inventor: Rhodes Wilkinson, Hyrum, UT (US)

(73) Assignee: GYM RAX INTERNATIONAL, INC., Santa Monica, CA (US)

( * ) Notice: Subject to any disclaimer, the term of this patent is extended or adjusted under 35 U.S.C. 154(b) by 158 days.

(21) Appl. No.: 15/167,951

(22) Filed: May 27, 2016

(65) Prior Publication Data

US 2016/0346582 A1 Dec. 1, 2016

Related U.S. Application Data

(60) Provisional application No. 62/167,824, filed on May 28, 2015.

(51) Int. Cl.

| | |
|---|---|
| ***A63B 69/20*** | (2006.01) |
| ***A63B 17/04*** | (2006.01) |
| ***A63B 71/00*** | (2006.01) |
| ***A63B 47/00*** | (2006.01) |
| *A63B 9/00* | (2006.01) |
| *A63B 65/06* | (2006.01) |
| *A63B 1/00* | (2006.01) |
| *A63B 21/072* | (2006.01) |
| *A63B 21/16* | (2006.01) |
| *A63B 23/12* | (2006.01) |
| *A63B 41/00* | (2006.01) |
| *A63B 21/00* | (2006.01) |

(52) U.S. Cl.

CPC ..... *A63B 17/04* (2013.01); *A63B 47/00* (2013.01); *A63B 71/0036* (2013.01); *A63B 1/00* (2013.01); *A63B 9/00* (2013.01); *A63B 21/072* (2013.01); *A63B 21/0726* (2013.01); *A63B 21/169* (2015.10); *A63B 21/1681* (2013.01); *A63B 21/4037* (2015.10); *A63B 23/1218* (2013.01); *A63B 23/1227* (2013.01); *A63B 41/00* (2013.01); *A63B 65/06* (2013.01); *A63B 69/20* (2013.01)

(58) Field of Classification Search

CPC ..... A63B 69/20; A63B 69/24

USPC ..... 248/231.9, 342, 343, 344; 403/204, 67, 403/72, 73, 74; 482/86, 87

See application file for complete search history.

(56) References Cited

U.S. PATENT DOCUMENTS 660,049 A * 10/1900 Cook ..... B25G 3/38 403/58

873,108 A * 12/1907 Throop et al. ..... F21V 21/14 222/370

991,807 A * 5/1911 Spade et al. ..... F16D 3/40 464/11

(Continued)

*Primary Examiner* — Michael Safavi

(74) *Attorney, Agent, or Firm* — Kleinberg & Lerner LLP; Marvin H. Kleinberg

(57) ABSTRACT

A modular kit of parts creates structures to store and suspend equipment used for physical fitness. A structure can be created that can store fitness equipment such as exercise balls, dumb bells, kettle bells and the like. Further, the structure can incorporate exercise bars, and can store and deploy such equipment as suspension straps, punching bags, heavy bags, yoga straps, which are suspended from multi axial pivoting anchors that afford no frictional resistance when the equipment is utilized for exercise.

1 Claim, 16 Drawing Sheets

(56) References Cited

U.S. PATENT DOCUMENTS 1,119,618 A * 12/1914 Lumley ..... F21V 21/02 174/86
1,263,783 A * 4/1918 Maier ..... F21V 21/14 248/323
1,285,202 A * 11/1918 Jaques et al. ..... E04B 1/4121 248/343
1,591,973 A * 7/1926 Grossheim ..... A63B 69/205 248/317
2,323,624 A * 7/1943 Schall ..... A63B 69/205 403/53
2,548,089 A * 4/1951 Wycosky ..... A63B 69/205 248/324
2,813,409 A * 11/1957 Wolcott ..... F16D 3/04 464/102
2,997,864 A * 8/1961 Rueb ..... F16D 3/38 464/112
3,103,798 A * 9/1963 Piatti ..... F16D 3/41 280/492
3,300,258 A * 1/1967 Kompanek, Jr. ..... F16C 33/14 384/280
3,778,860 A * 12/1973 Thielen ..... B25G 3/38 15/144.2
3,850,533 A * 11/1974 Thielen ..... B25G 3/38 403/154
4,084,812 A * 4/1978 Melrose ..... A63B 9/00 273/348
D258,115 S * 2/1981 Piatek ..... 248/317
4,272,972 A * 6/1981 James ..... F16D 3/38 403/58
4,365,488 A * 12/1982 Mochida ..... F16D 3/38 403/57
4,422,334 A * 12/1983 Yasuda ..... B06B 1/10 403/57
4,561,797 A * 12/1985 Aldridge ..... A01D 75/30 172/314
4,648,738 A * 3/1987 Thielen ..... F16B 7/22 15/144.2
5,201,896 A * 4/1993 Kruszewski ..... F16M 11/10 248/278.1
5,389,039 A * 2/1995 Mazziotti ..... F16C 21/005 403/36
5,409,332 A * 4/1995 Chabot, Jr. ..... B25B 23/0014 403/114
5,596,787 A * 1/1997 Stevens ..... A47L 1/15 15/144.2
5,649,778 A * 7/1997 Lin ..... B23Q 1/0027 403/31
5,660,491 A * 8/1997 Roberts ..... B25B 15/001 403/322.1
5,692,959 A * 12/1997 Schabel ..... F16D 3/40 464/134
6,227,749 B1 * 5/2001 Fujii ..... F16C 11/045 174/43
6,347,900 B1 * 2/2002 Sadakata ..... B21D 28/32 29/558
6,383,081 B1 * 5/2002 DeBisschop ..... F16D 3/40 464/114
6,579,186 B2 * 6/2003 Fischer ..... F16D 3/40 464/136
6,708,940 B2 * 3/2004 Ligertwood ..... F16M 11/10 248/279.1
6,758,623 B2 * 7/2004 Bushey ..... F16C 11/06 403/120
7,036,780 B1 * 5/2006 Geninatti ..... A63B 29/02 114/230.1
7,140,969 B2 * 11/2006 Prucher ..... F16D 3/387 464/134
7,341,545 B2 * 3/2008 Cao ..... A63B 21/15 403/150
7,827,649 B2 * 11/2010 Horian ..... A47L 13/254 15/144.1
7,837,167 B2 * 11/2010 Hartwig ..... A61M 5/1415 248/284.1
8,333,526 B2 * 12/2012 Long ..... F16D 3/38 403/57
8,342,475 B2 * 1/2013 Tsakiris ..... A63B 69/201 248/343
8,449,620 B2 * 5/2013 Hakansson ..... A61F 2/4241 623/22.16
8,900,103 B1 * 12/2014 Tabino ..... A63B 69/205 482/83
2002/0094917 A1 * 7/2002 Wang ..... A63B 43/007 482/86
2010/0227743 A1 * 9/2010 Jutte ..... A63B 21/16 482/87

* cited by examiner

MULTI-AXIAL PIVOTING ANCHOR

BACKGROUND OF THE INVENTION

1. Field of the Invention

The present invention relates to modular structures and, more particularly, modules capable of being assembled into various articles of fitness facility equipment with the capability of storing and/or suspending various exercise accessories.

2. General Background and State of the Art

In most fitness facilities, structures to store and/or suspend equipment and accessories are individually created. Exercise apparatus generally requires a separate structure to accommodate it. Other structures such as vertically aligned parallel bars are installed as a wall fixture.

There are sources of modular equipment that can provide structures that can fit in spaces using standardized elements that are adjustable so that skilled installers are not required. One such system is shown and described in the application to Scaramucci, Publication No. US 2014/0054247. Other systems are designed for installation to a wall or ceiling. However, such structures are not necessarily designed to store equipment as a primary function and to accommodate exercise and physical training equipment that can be deployed for use and retrieved when free floor space is desired.

INVENTION SUMMARY

According to the present invention, a plurality of modular elements have been designed for the unique task of serving a physical fitness facility. These elements can create structures that can be configured into assemblies that store physical training equipment such as exercise balls, dumb bells, kettle bells and the like. Using unique, cantilevered shelves, these items, which collectively can be quite heavy, require special support afforded by the structures of the present invention.

Because of the weight of the objects that are being stored, the structures should be firmly embedded in the facility floor and some of the modules of the present invention make such attachments both simple and practicable. Using the inventory of modules, additional structures can be fabricated which can be elements of exercise and fitness devices such as suspension straps, climbing bars, punching bags, pull up bars, monkey bars, dip bars, seats, steps and other appliances for facilitating physical fitness exercises. Of course, wherever possible, existing "off the shelf" products will be integrated into the system.

The basic structural elements are powder coated box tubes of standard length. These can be both vertical and horizontal support members to which u-shaped channel members can be attached. To minimize inventory needs, basic tubes of a standard length are provided. Smaller tube increments can be attached to the standard tube to extend it to a desired greater length The u-shaped channel members include a series of slots which accommodate tabs on shelf elements. While tabs and slots are well known combinations for adjustable shelving, the shelves of the present invention include oversized tabs which must be rotated for insertion into the slots. The shelves further include shelf support rods which bear against the channel to resist rotation of a shelf about the tabs when heavy objects are stored on the shelf. In alternative embodiments shelves are provided with pairs of tabs which can utilize more than one slot thereby providing multiple anchor points for the support of heavy equipment.

Special gussets are provided to cooperate with base plates for resisting tipping forces and other gussets are provided to permit cantilevered box tubes that can extend either to create additional structures or to support athletic equipment suspended therefrom. Parts are assembled utilizing conventional nuts and bolts. Where apertures in the box tubes are used for the connection of other elements that might place substantial stresses on the apertures, a special tube is mounted in the aperture to provide extra wall strength to the coupling device.

An integral part of the structure designed for the purpose of suspension is a multi-axial pivoting anchor useful in attaching a variety of exercise equipment such as, suspension training straps, punching bags, heavy bags, yoga hammocks, ropes, and the like to the modular structure of the present invention. The anchor is created during the product assembly process.

BRIEF DESCRIPTION OF THE DRAWINGS

FIG. 2, includes FIGS. 2A, 2B and 2C where FIG. 2A is a perspective view of the base of an upright where it fastens to a substrate while

FIG. 3 includes FIGS. 3A and 3B where FIG. 3A if a perspective view of the top of an upright with an orthogonal member attached thereto while

FIG. 6 includes FIGS. 6A and 6B where FIG. 6A is perspective view of the front of a structure supporting shelves while

FIG. 13 including

FIG. 15, including

FIG. 16, including

DETAILED DESCRIPTION OF THE PREFERRED EMBODIMENTS

Figure 1:
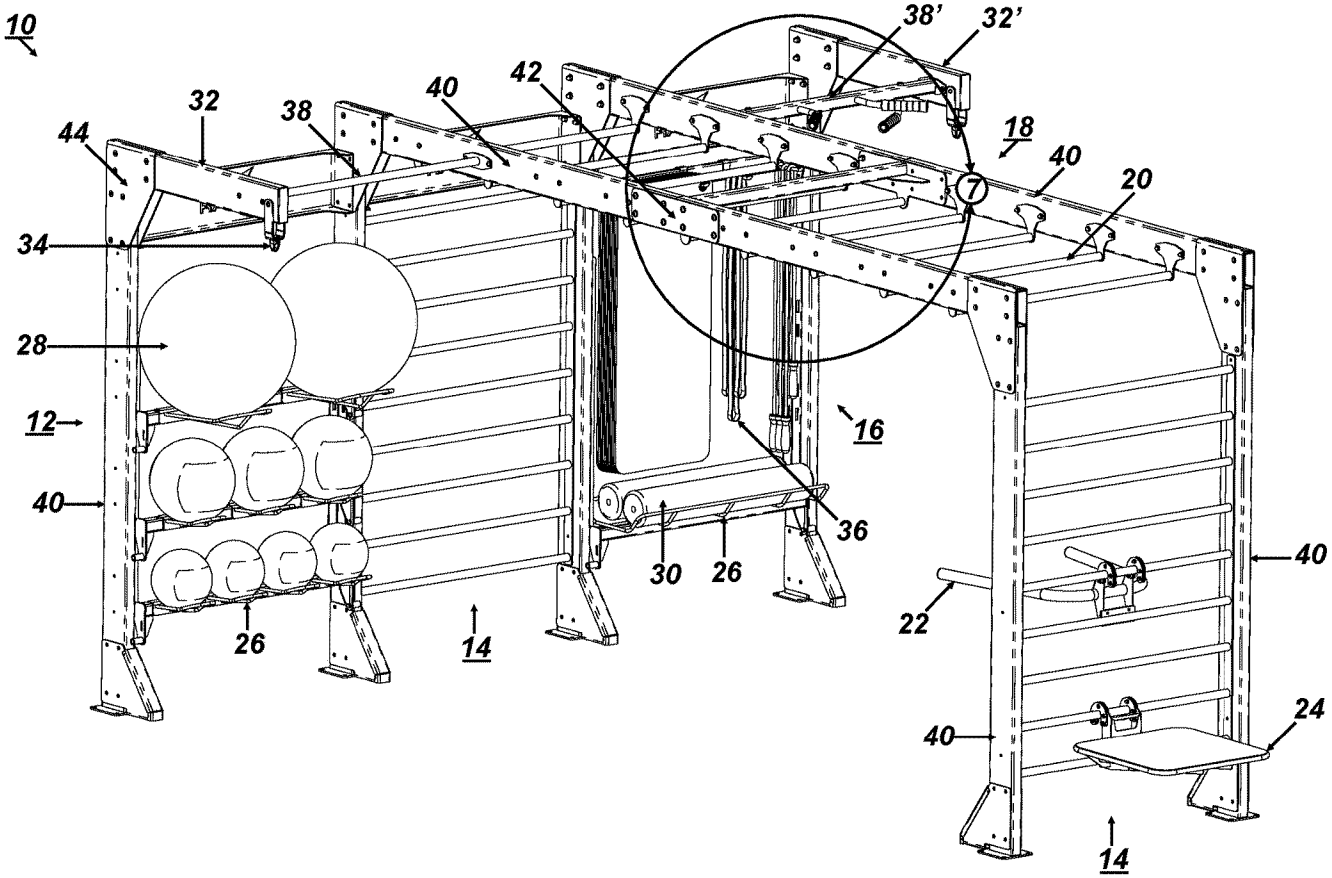
FIG. 1 is a perspective view of an assembled apparatus according to the present invention.

Turning first to FIG. 1, there is shown a structure 10 created from the modules of the present invention. As shown, the structure 10 includes a storage rack 12, wall bars 14, a storage bay 16, a bridge element 18 with integral monkey bars 20. Suspended from the wall bars 14 are a dip bar 22 and a step element 24.

The storage rack 12 includes a plurality of shelf elements 26 which can be configured to support balls 28 of various sizes, tubes 30, and other pieces of gym apparatus such as dumb bells, kettle bells and other weighty objects, none of which are shown as being stored in storage rack 12.

Mounted at the top of the storage rack 12 is a cantilever arm 32 with a mounting ring 34 at its outer end from which can be suspended other fitness elements such as training or fitness bags (not shown) or suspension straps 36 shown stored in the storage bay 16. A second cantilever arm 32' extending from the storage bay 16 supports a pull up bar 38 as does the bridge element 18. A circle 7 encloses elements which are described in greater detail in FIG. 7.

Figure 5:
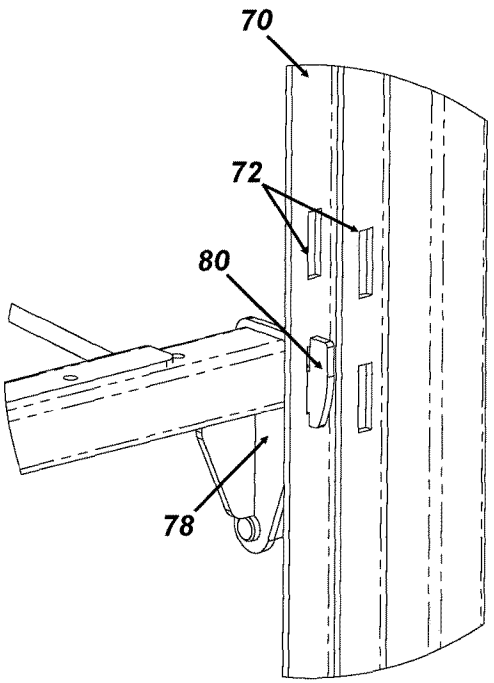
FIG. 5 is a perspective view of the rear of the structure of FIG. 4.
Figure 4:
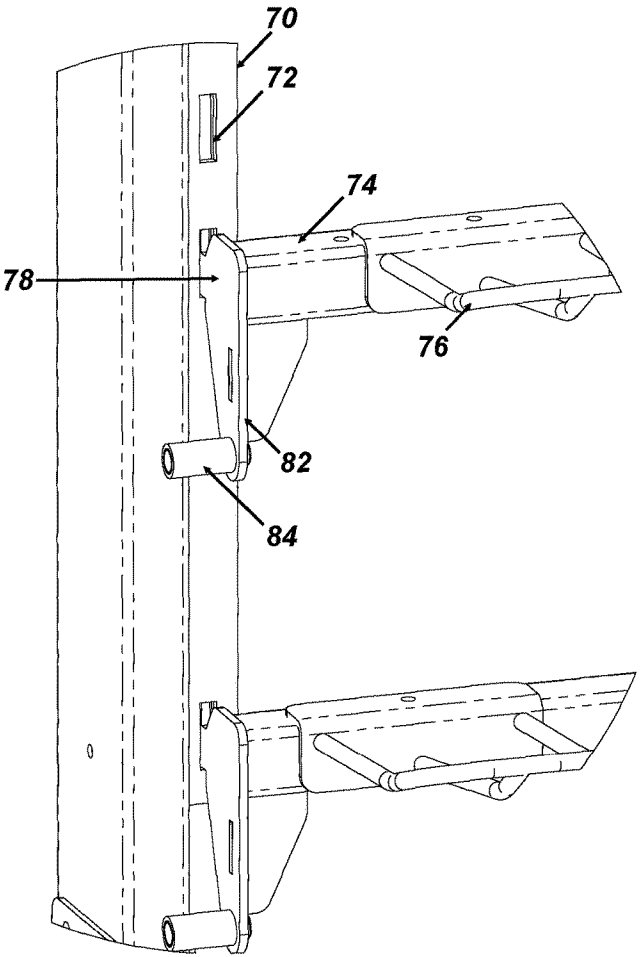
FIG. 4 is a perspective view of a slotted channel with a shelf installed therein.

The basic structural element is the post beam 40 which, in the preferred embodiment is a 6"×2" tube with a standard length of 7 feet. Shorter tubes (not shown) can be coupled to achieve greater lengths using connector plates 42 which are shown to connect two beams 40 to form the bridge element 18. Gusset plates 44 connect vertical beams 40 to horizontal beams 40 to create either the cantilever arms 32 or the bridge elements 18. While, in the preferred embodiments, a u-shaped channel, shown and described in FIGS. 4 and 5, is provided to support shelves, in alternative embodiments, the beams 40 can be provided with slots on one or more sides to permit the installation of shelves, support pegs or support arms for the storage of other equipment, such as bar bells.

Figure 2C:
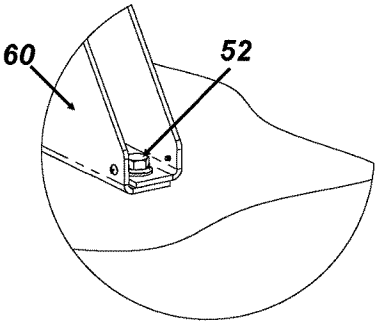
FIG. 2C is an enlarged view of a portion of the structure.
Figure 2B:
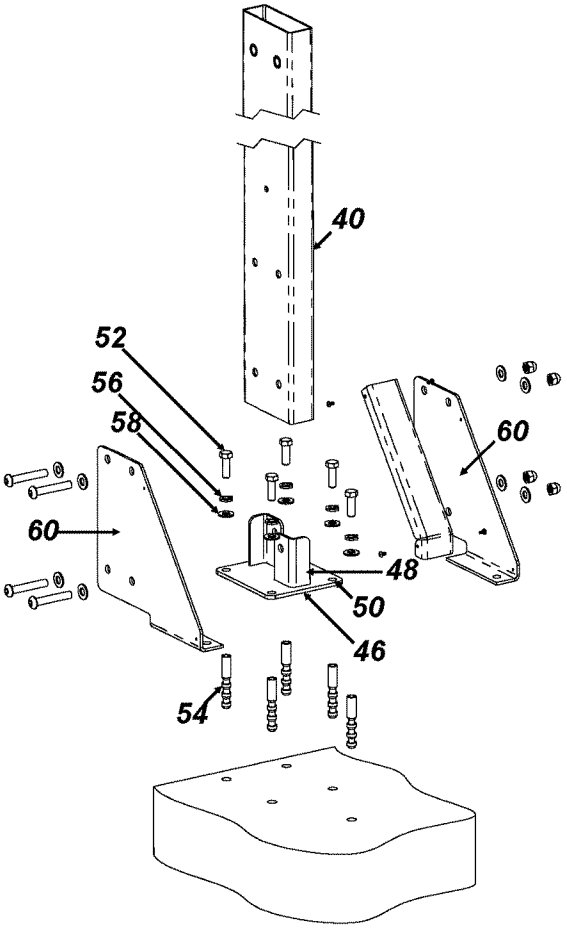
FIG. 2B is an exploded view of the structure of FIG. 2A
Figure 2A:
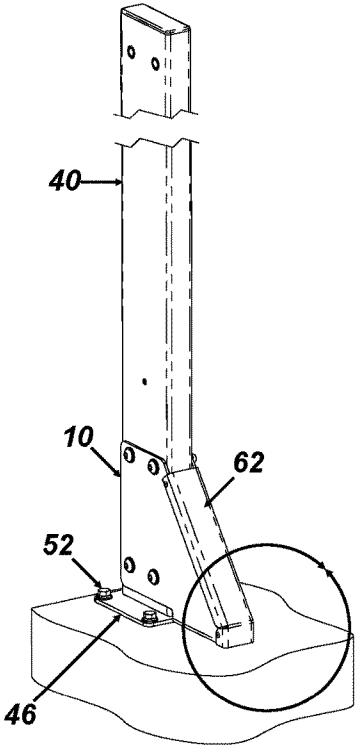

Turning next to FIG. 2 there is shown the structure that allows the assembled structures to be anchored to a floor or other substrate. While FIG. 2A shows the finished product, the constituent elements are best seen in FIG. 2B. A base plate 46 has fastening posts 48 to secure it to a beam 40. The base plate 46 has apertures 50 through which fastening bolts 52 or floor mounted bolts (not shown) can be inserted. Where bolts 52 are utilized, female threaded anchors 54 are secured into the floor. When the bolts 52 are used to secure the base plate 46 to the floor, it is preferable to use lock washers 56 and flat washers 58. In alternative embodiments, bolts can be embedded in the floor and the base plate 46 would be secured by nuts and washers.

In the preferred embodiment, a base gusset comprised of opposing flanged plates 60 is fastened to the beam 40. At a leading end of the flanges of the flanged plates 60, best seen in FIG. 2C, an aperture is provided for an additional bolt 52 for added restraint of the beam 40. For cosmetic purposes, a foot cover 62 is fastened over the front of the flanged plates 60. In alternative embodiments, the gusset plates used at the base of the beam 40 serving as a vertical support, could also be used to fasten horizontally oriented beams 40 to be cantilevered.

Figure 3B:
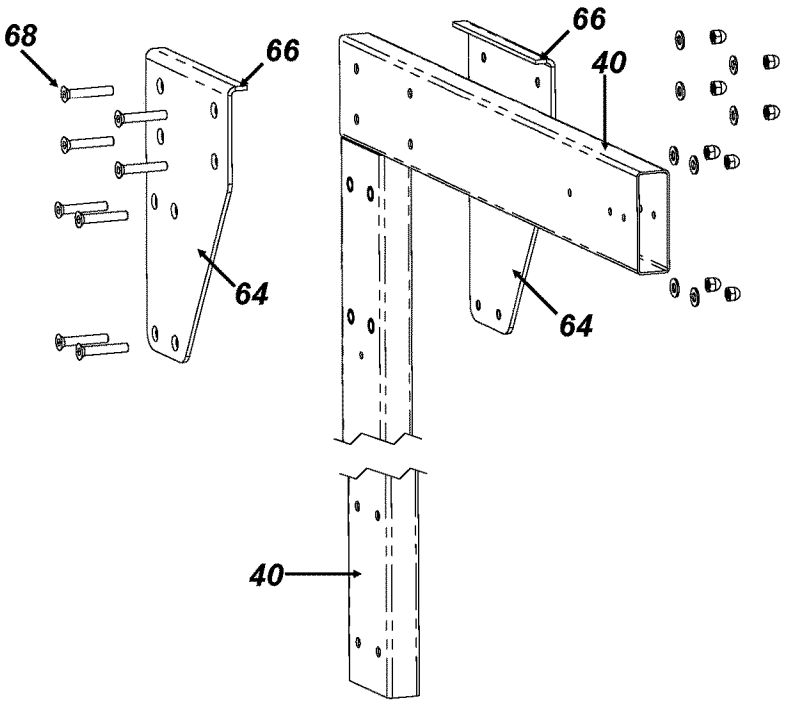
FIG. 3B is an exploded view of FIG. 3A.
Figure 3A:
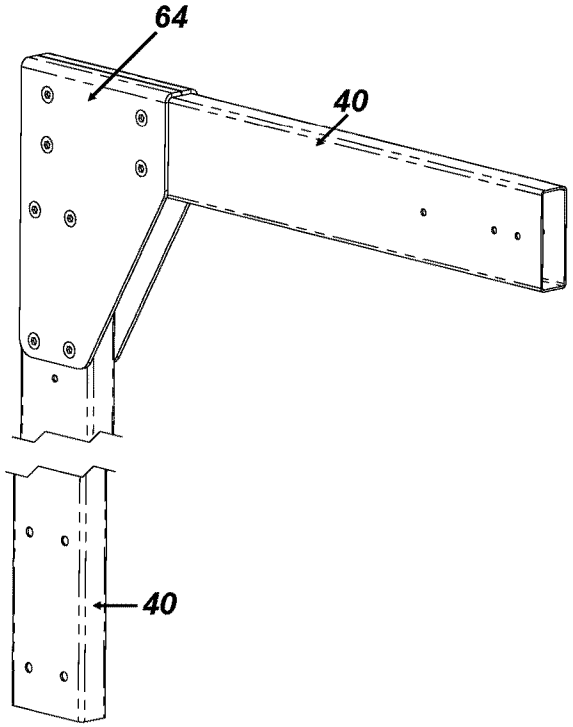

Such a connection is illustrated in FIG. 3. However, in the preferred embodiment, a different, upper gusset is also comprised of a pair of opposed, flanged upper gusset plates 64. In alternative embodiments, the same gusset plates could be used at both the top and bottom of the beams 40. As shown, a horizontally oriented beam 40 is positioned atop a vertically oriented beam 40. The flanges 66 hold the horizontal beam 40 in place, reducing the stress on the fasteners 68 which connect the gusset plates 64 to both beams 40.

Turning next to FIGS. 4 and 5 where there is shown in front and rear perspective views, a bracket channel 70 according to a preferred embodiment. The bracket channel 70 is adapted to be fastened to a wall of beam 40 to adjustably support shelves, pegs, brackets and other accessories that could be suspended from a beam 40. The bracket channel 70 is a u-shaped member with aligned elongated slots 72 in the side walls of the channel 70.

In the preferred embodiment, shelves are comprised of a bar 74 to which can be attached various brackets 76 that are shaped to accommodate the different accoutrements of fitness training. For example, various support elements are sized to fit different sized exercise balls. Other support elements can hold dumb bells. A plurality of support elements are maintained in inventory to be attached, as needed to a shelf bar 74.

At each end of a shelf bar 74 is an end plate 78 which has extending therefrom an elongated tab 80 which is longer than the slots 72. By tilting the end plate 78, the tab 80 can be inserted into a slot 72. Straightening the end plate 78 results in the tab 80 resting in the slot 72. In alternative embodiments, a notch may be provided on the lower surface of the tab 80 which can engage the lower edge of the slot 72 to lock the end plate 78 in place.

For additional support, the end plate 78 includes a support arm 82 which has, at its lower end, a support rod 84 that bears against the beam 40. This arrangement more strongly resists any rotational forces resulting from weighty objects being stored on the shelf. Absent the support arm 82 and rod 84, stress would be exerted only on the upper part of the tab 80. With the support arm 82 and rod 84, rotational forces would be converted into a force that is substantially lateral which can be resisted by both ends of the tab 80.

Figure 6B:
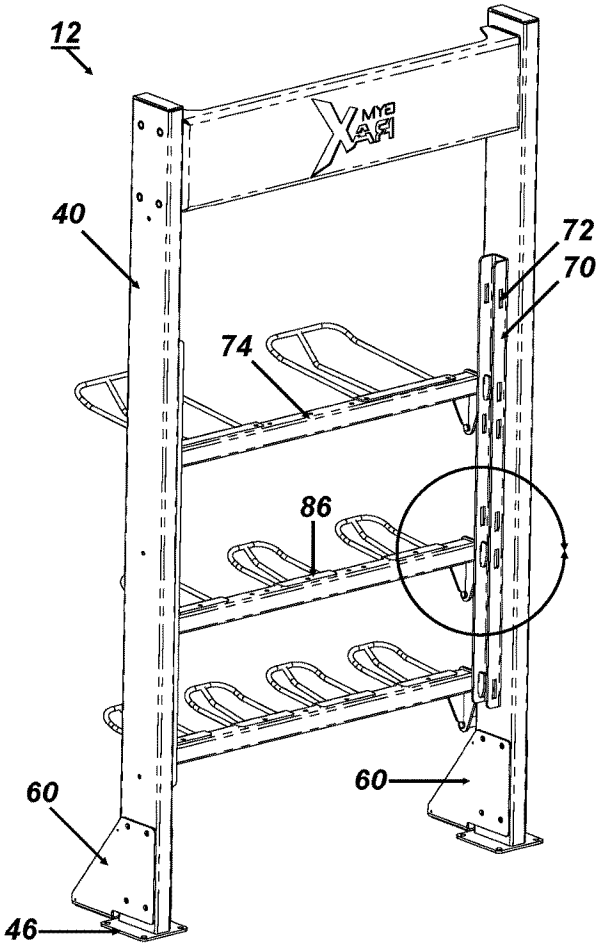
FIG. 6B is a rear view of the structure of FIG. 6A.
Figure 6A:
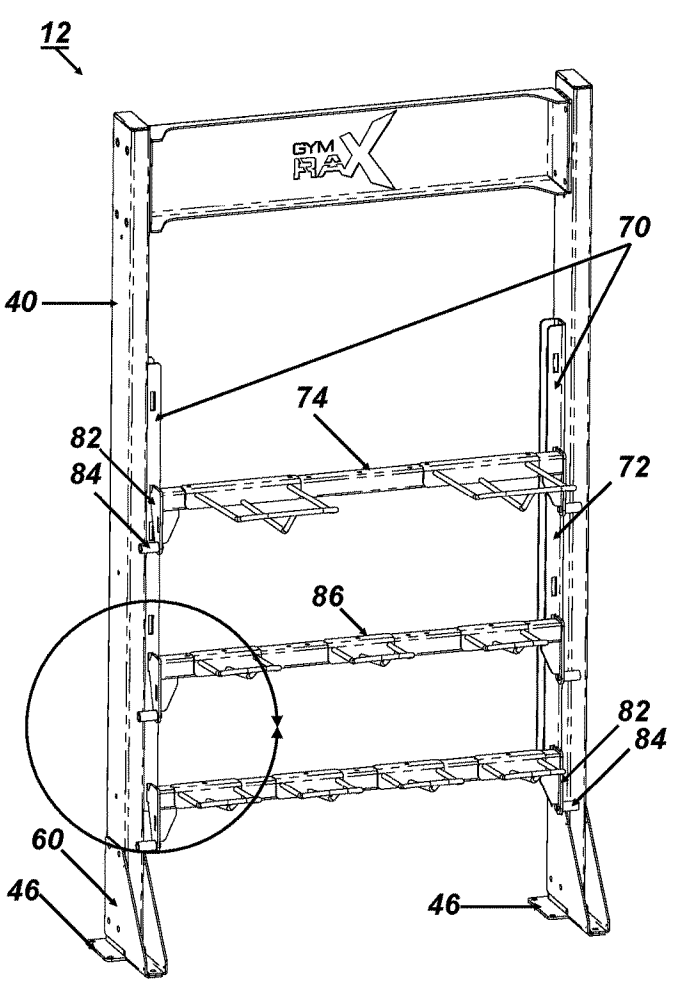

Turning next to FIGS. 6A and 6B, there is shown a typical storage rack 12. FIG. 6A is a front perspective view and FIG. 6B is a rear perspective view. The component parts have been described in earlier FIGS. Shown here are alternative brackets for the support of fitness equipment. Common to the illustrated support brackets is the u-shaped cantilevered element which has a linear support brace 86 extending from the outermost end of the bracket to the shelf bar 74.

Figure 7:
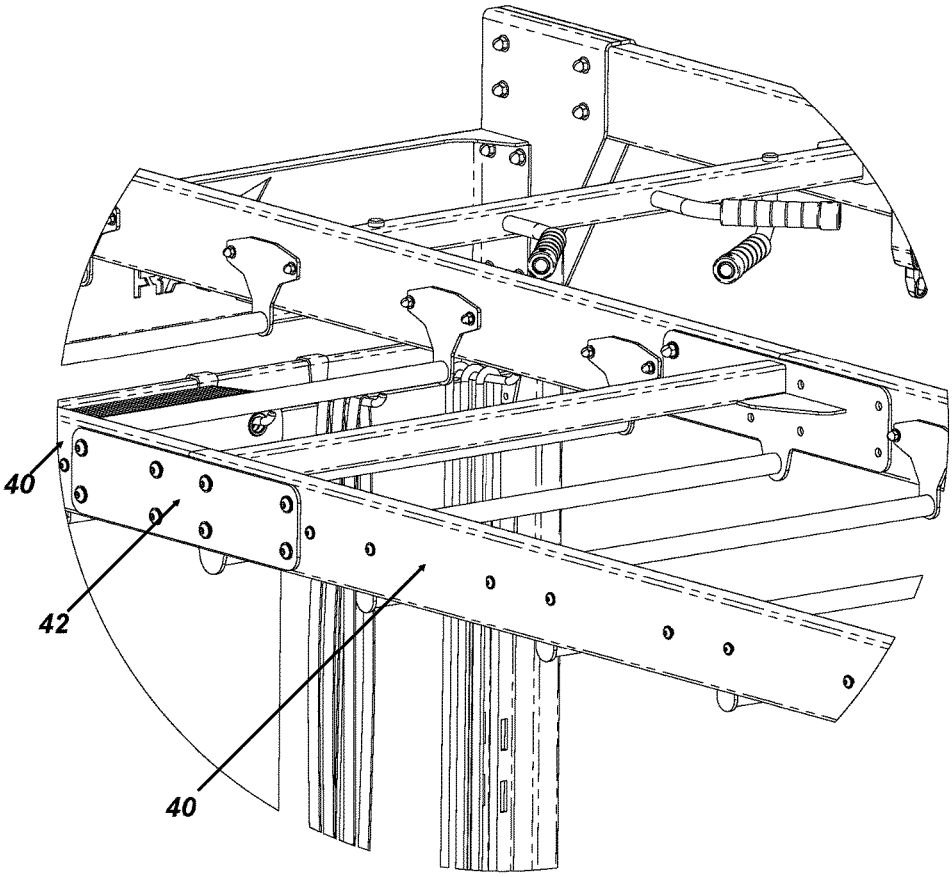
FIG. 7 is detailed perspective view of the section of FIG. 1 identified by the reference numeral 7.

FIG. 7 is a more detailed view of the elements of the bridge structure shown in FIG. 1. A bridge connector plate 88 couples two beams 40 together.

Figure 8:
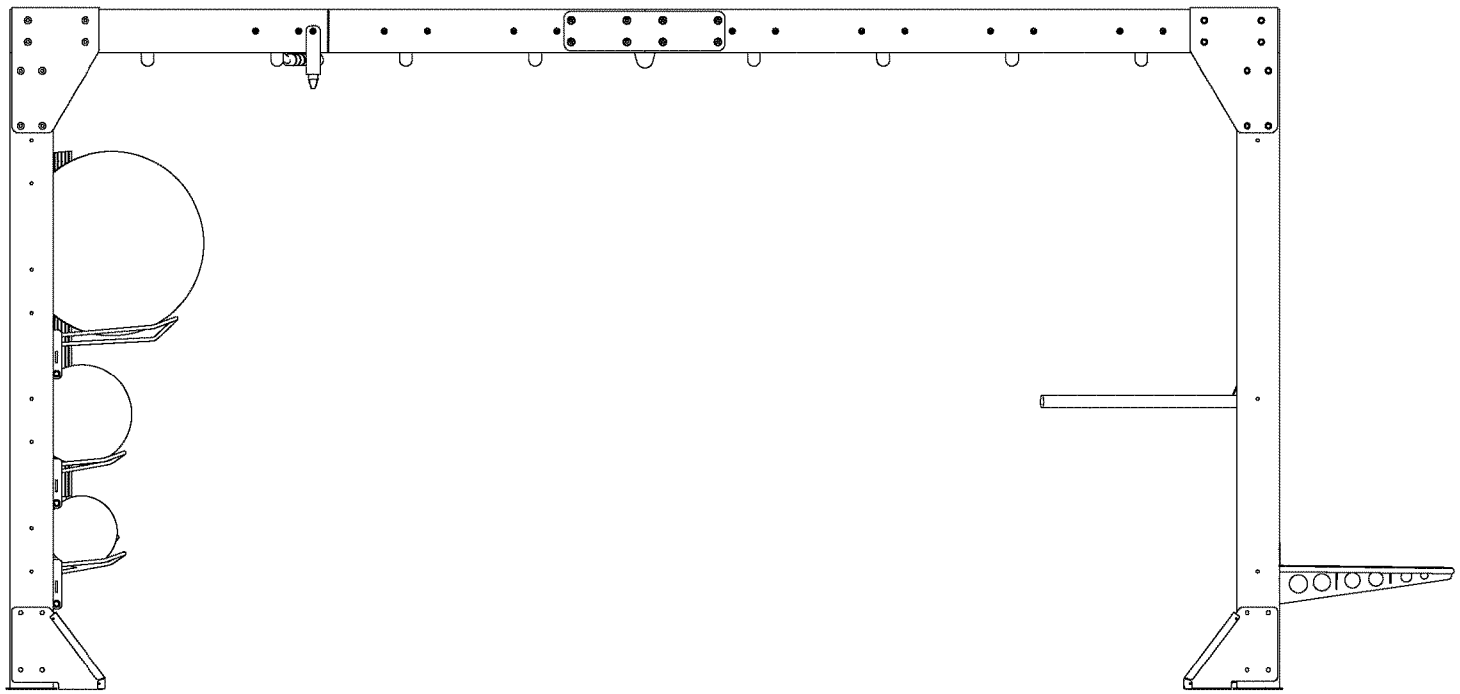
FIG. 8 is a side view of the structure of FIG. 1.

FIG. 8 is a side view of the structure of FIG. 1 and need not be further described here.

Figure 9:
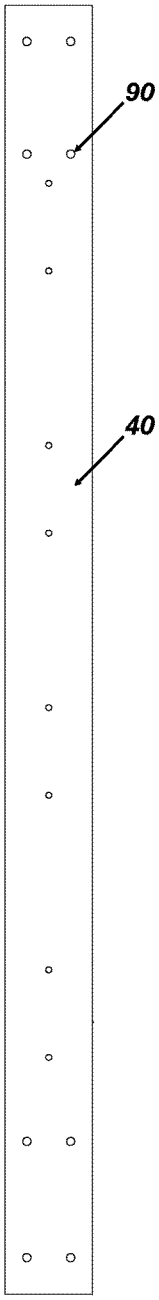
FIG. 9 is a plan view of a reinforced beam.

FIG. 9 is a view of a post beam 40 which has been reinforced with tubular cylinders 90. These tubular cylinders 90 or crush tubes, bear the forces that result when post beams 40 are connected end-to-end with connecting plates 42 as in the bridge structures of FIG. 1. Absent the crush tubes 90, substantial stresses on the joint might bear on the apertures through which connectors would pass and cause deformations in the beam 40 wall.

All forces experienced by the connectors are distributed through the crush tubes 90 Because these tubes 90 are welded into place they protect the post beam 40 not only from orthogonal forces that would lead to bending, but also from any deformation of the side wall when the connectors are tightened.

Figure 10:
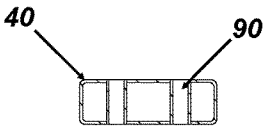
FIG. 10 is a side sectional view of the reinforced beam of FIG. 9, taken along line 10-10 in the direction of the appended arrows.

FIG. 10 is a side view of the beam 40 of FIG. 9, and shows the crush tubes in place. As noted above, the tubes 90 are secured in place by welding or other permanent attachment to the beam 40. Should the connection plates 42 (not shown here) be subjected to forces that might deform the beam 40 walls, the tubes 90 can resist such forces and prevent any deformation.

Figure 11:
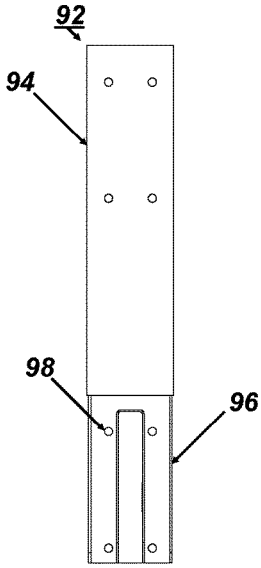
FIG. 11 is a plan view of an extender module.

Turning next to FIG. 11, there is shown an extender module 92 which can add a desired length to a beam 40 for those applications where a longer beam is required. The module 92 is so configured that a plurality can be connected end to end to extend the length by an amount that is less than the length of the beam 40. The extender module 92 has a first section 94 which has the same circumferential size and shape as a beam 40. A corrugated portion 96 is anchored in the first portion 94 and is sized to be inserted into a beam 40. As shown, four holes 98 are placed so that when the corrugated portion 96 is fully inserted into a beam 40 end, the holes in the beam 40 are aligned with the holes 98.

Figure 12:
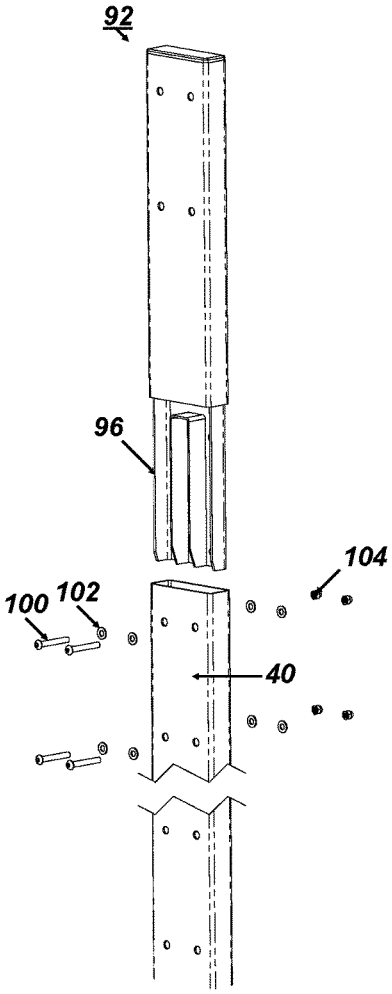
FIG. 12 is a perspective exploded view of the module of FIG. 11 aligned with a post beam.

The exploded view of FIG. 12 shows the relationship of the component parts. With the corrugated portion 96 fully seated into the beam 40, connector elements, here bolts 100, washers 102 and nuts 104, fasten the extender module 92 to a beam 40.

Figure 13A:
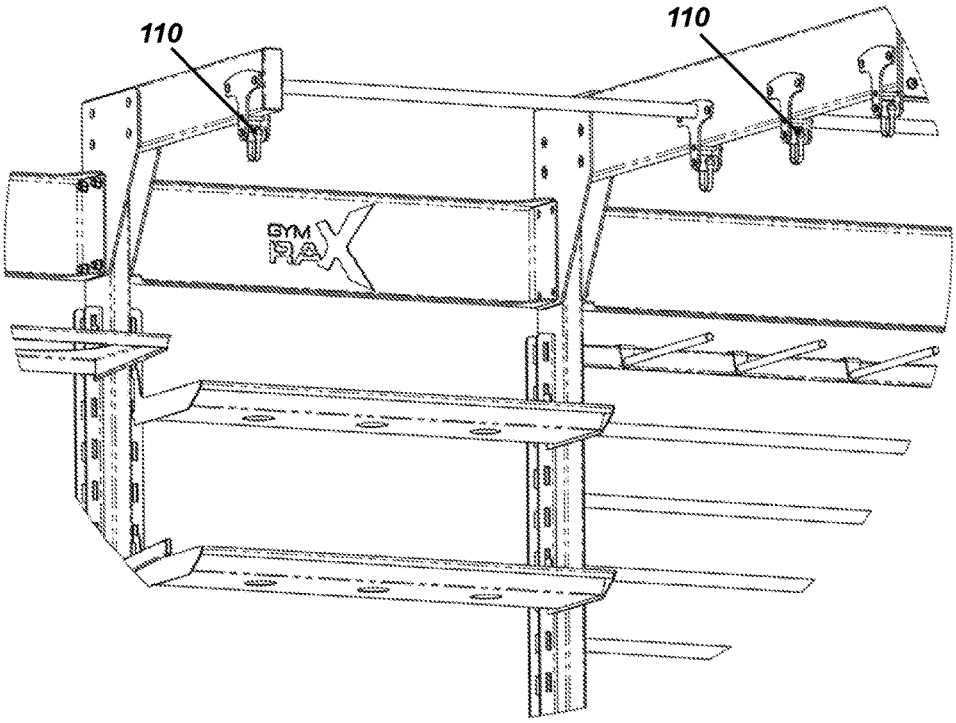
FIGS. 13*a* and 13*b* is a partial view of the structure, showing multi-axial pivoting anchors attached thereto and an exploded view showing the attachment.
Figure 13B:
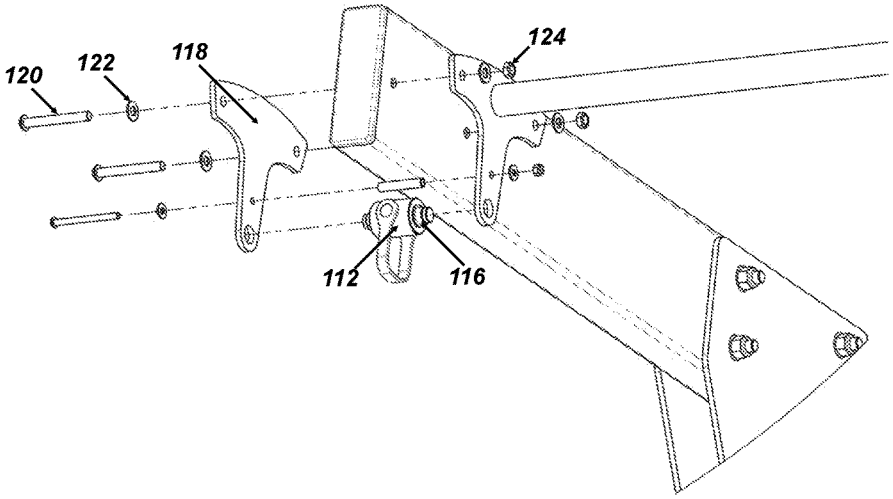

Pivoting mechanisms 110 are attached to the structure at the ends of the beams 40 and along the bridge element 18 at specific locations as shown in FIG. 13*a* The pivoting anchors 110 are attached to a post beam 40 by inserting the ends of trunion axle 112 with bearings 116 through holes in adjoining mounting plates 118 which are bolted to the modular structure as shown in FIG. 13*b*. using bolts 120 which are secured with washers 122 and nuts 124 best seen in FIG. 13*b*.

Figure 14A:
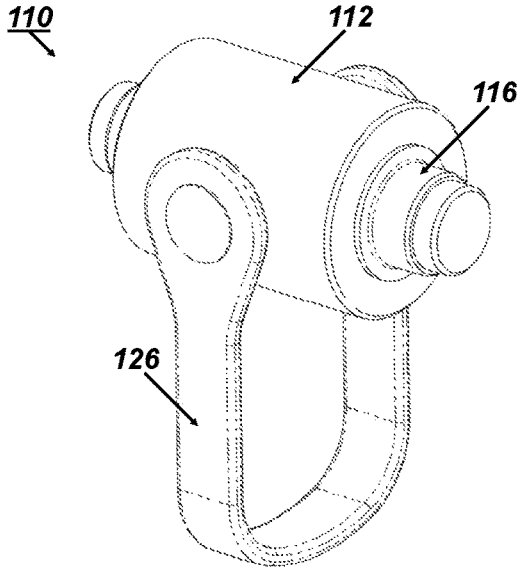
FIG. 14, including FIG. 14*a* which shows the assembled anchor and FIG. 14*b* which shows the disassembled anchor.
Figure 14B:
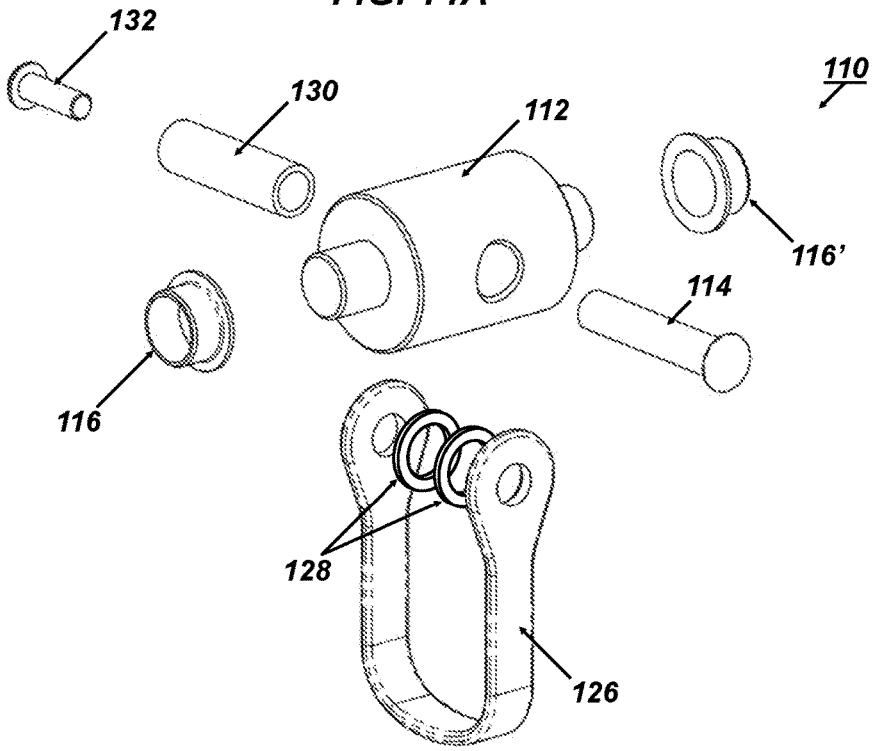

In FIGS. 14A and 14B, there is shown assembled and in exploded view, the multi-axial pivoting anchor 110 which is used to attach a variety of exercise equipment such as, suspension training straps, punching bags, heavy bags, yoga hammocks, ropes, and the like to the modular structure of the present invention and is an integral part of the modular structure. The anchor 110 is created during the product assembly process.

As shown in FIGS. 14A, 14B, the pivoting anchor mechanisms 110 is comprised of a central hub or trunion axle 112, secondary axle 114, shackle 126, trunion bearings 116, 116' center bearing 118, thrust bearings 128, and capture bolt 132. The center bearing 118 is inserted into the trunion axle 112. Thrust bearings 128 are located between the shackle 126 and trunion axle 112. The secondary axle 114 is inserted through holes in the end of the shackle 126, continuing through the thrust bearings 128, through the center bearing 130 and contained with the capture bolt 132. The shackle 126 rotates freely around the secondary axle 114, while the trunion axle 112 rotates freely upon bearings 116, 116'

The pivoting mechanism 110 allows for freedom of movement of any fitness equipment attached to the mechanism because the attached load pivots through two simultaneous axes. This apparatus is a replacement for chains, webbing straps, cables or other means which are attached to a fixed anchor point which creates a resistance to the natural rotating and pivoting nature of an object swinging and or turning through its range of motion. While the pivoting mechanism 110 is shown as attached to a beam, its use is not so limited. The mounting plates 118 can be affixed to any suitable structure such as a wall or ceiling mount, widening the applicability of this element of the present invention.

Figure 15A:
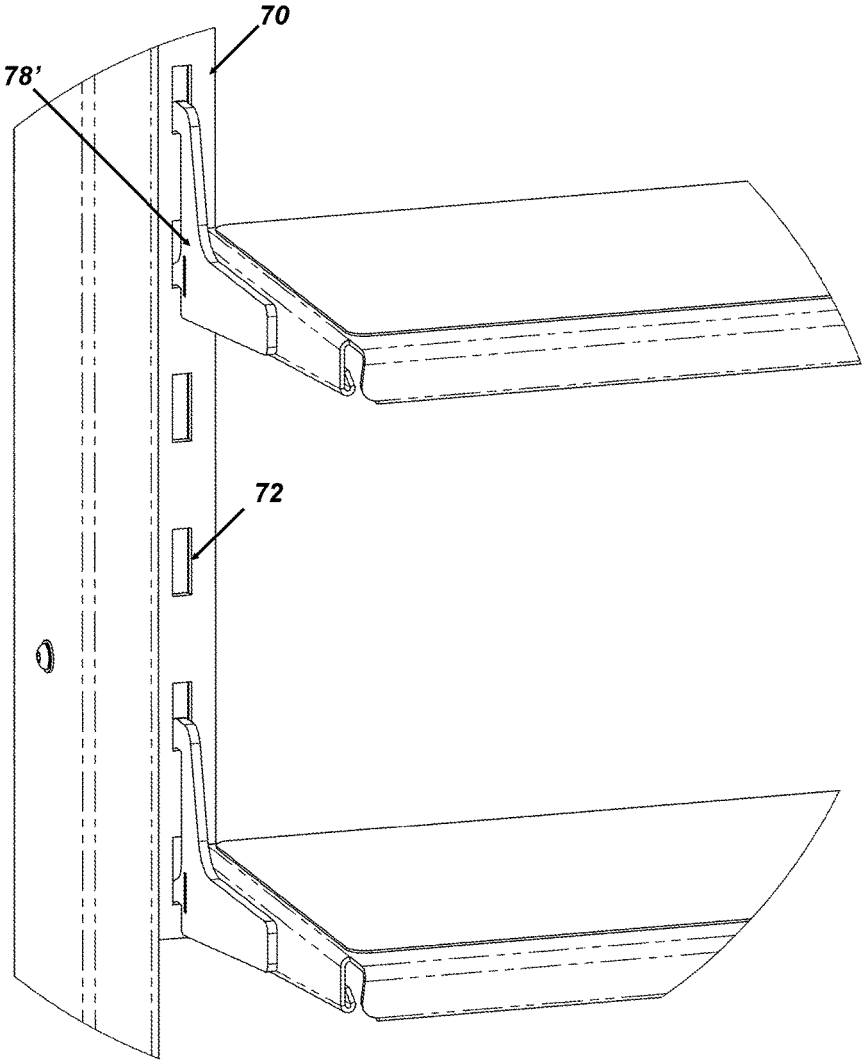
FIGS. 15*a* and 15*b* show front and rear views of an alternative shelf mounting structure.
Figure 15B:
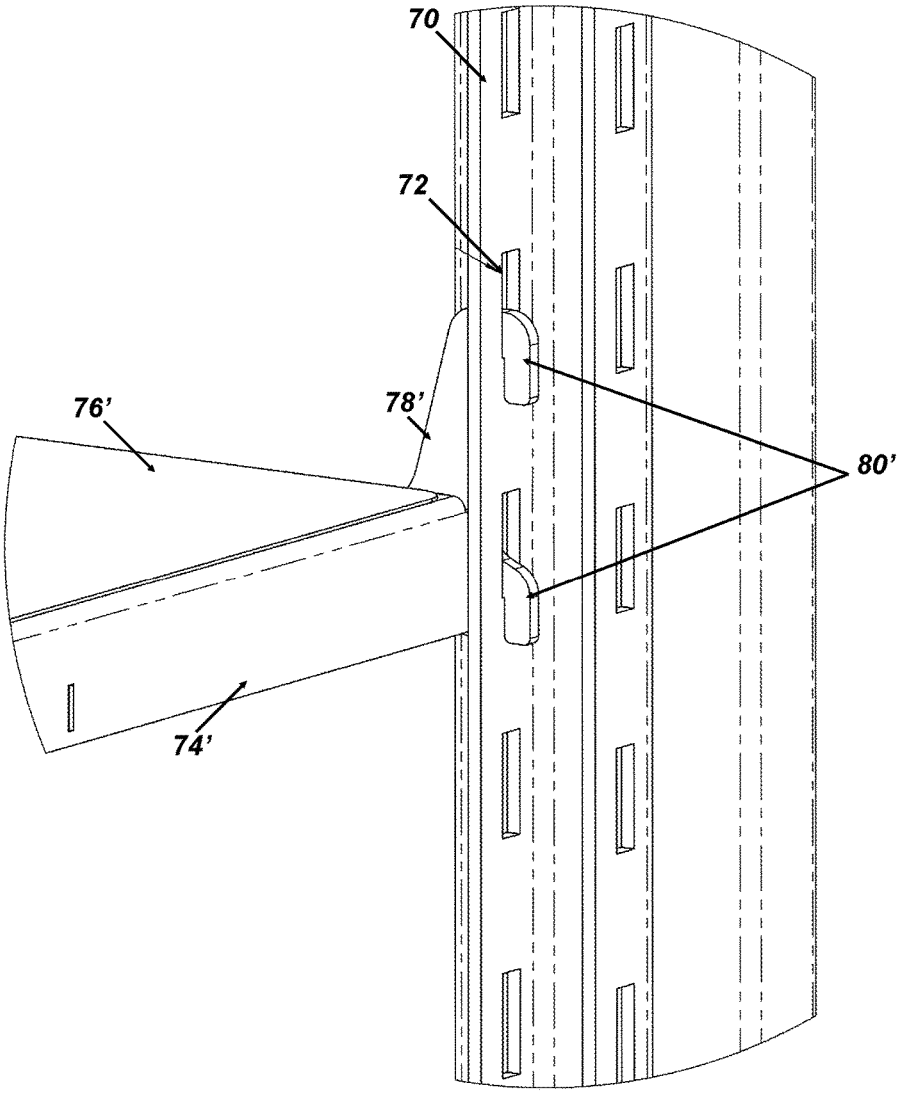
Figure 16A:
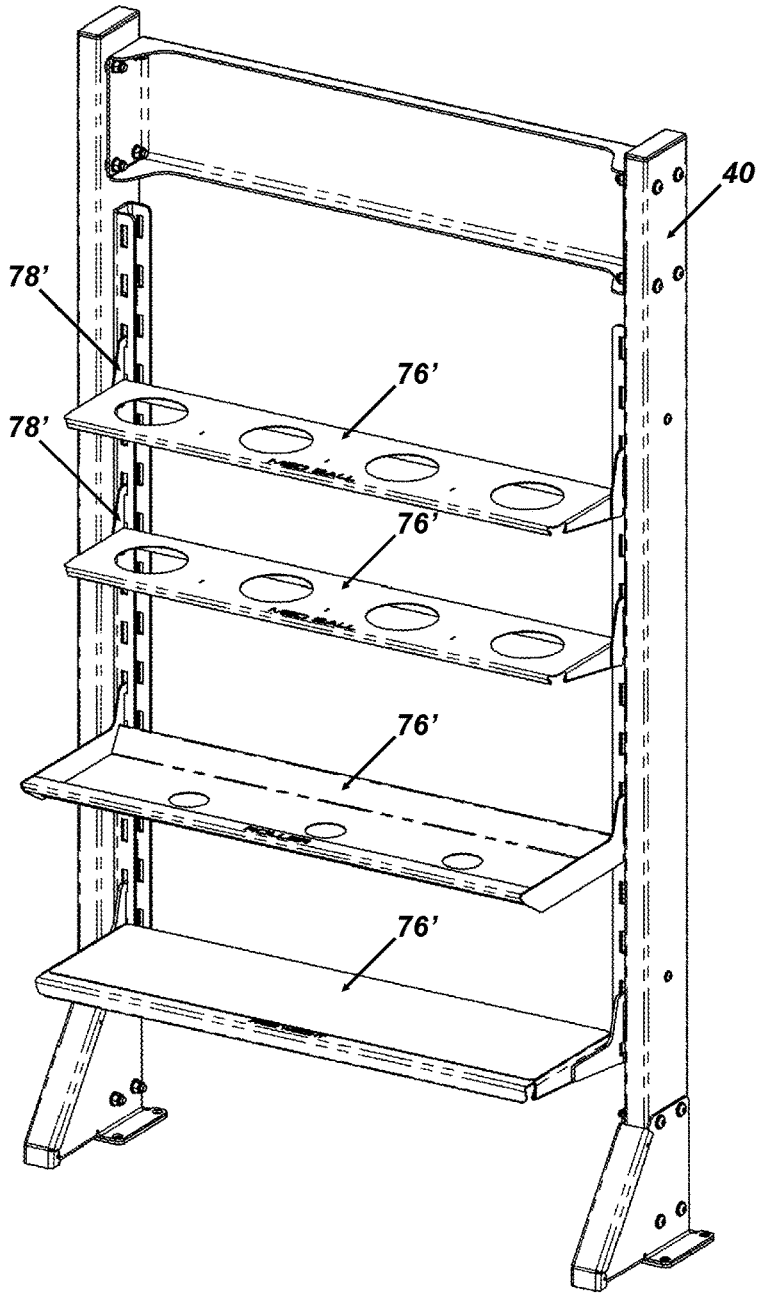
FIGS. 16*a* and 16*b* show perspective front and rear views of shelves with the alternative shelf mounting structure of FIG. 15.
Figure 16B:
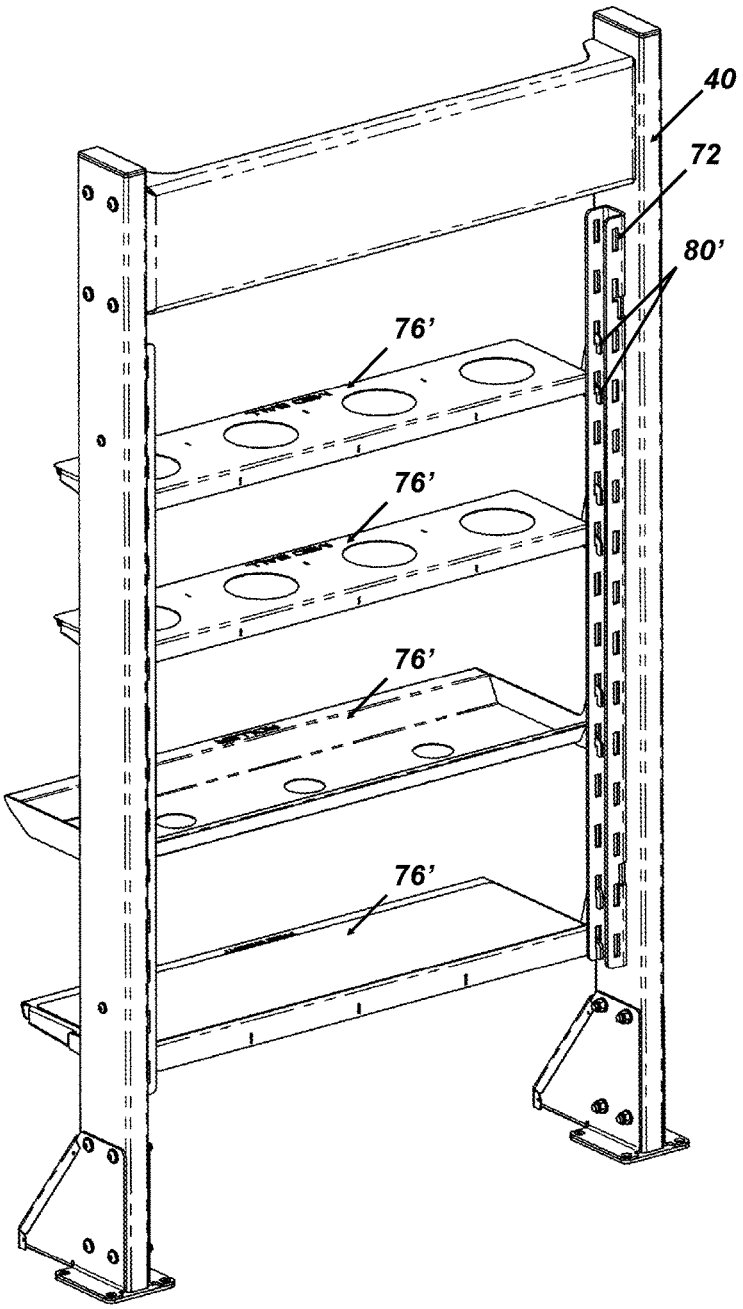

Turning next to FIGS. 15 and 16 where there is shown in front and rear perspective views, an alternative embodiment of apparatus for connecting a shelf bar 76' to the bracket channel 70. described above in connection with FIG. 4 In the alternative embodiment, shelf elements 26' are comprised of formed sheet metal of various shapes or designs. As in the above figures, there is provided a-bar 74' to which can be attached-various brackets 76' that are shaped to accommodate the different accoutrements of fitness training.

At each end of each shelf bar 74' is an end plate 78' which has extending therefrom a pair of elongated tabs 80'. The end plate 78' is long enough to utilize more than one slot 72. The tabs 80' can be inserted into two slots 72 which, in this embodiment, are adjacent. As a result, two tabs 80' rest in two slots 72. The upper tab 80' provides the resistance against rotations that the support arm 82 of the preferred embodiment provides.

It should be noted that the use of the u-shaped bracket channel 70 with slots 72 allow shelves or the like to be mounted on both sides of a beam 40 at the same level using either of the disclosed mounting configurations. A pair of back-to-back shelves could accommodate elongated items that might not easily fit on a single shelf, adding greater flexibility to the storage capabilities of the modular structure of the instant invention.

Figure 17:
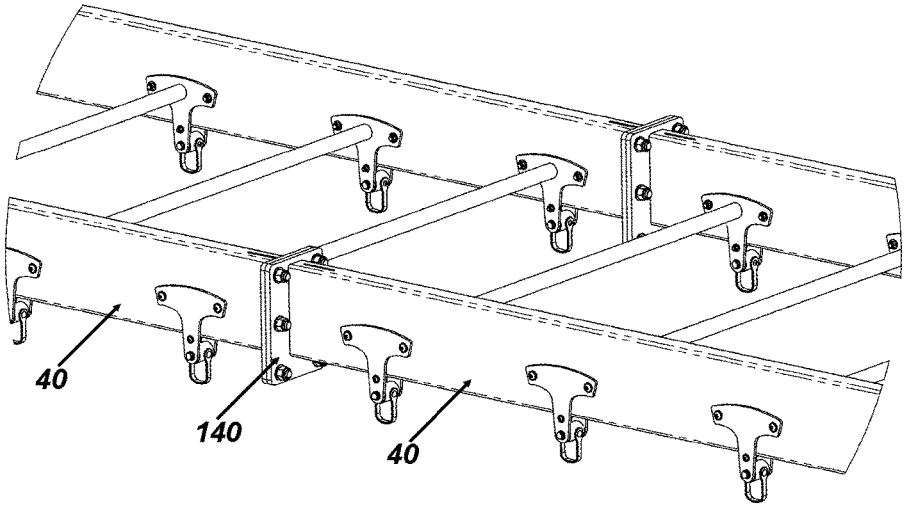
FIG. 17 is a partial view of an alternative embodiment of the bridge element using flanges to connect components.

Turning to FIG. 17, there is shown an alternative manner of coupling two beams 40 together. In the embodiment illustrated in FIG. 1, the beams 40 are joined by a connector plate 42. Here, an alternative is provided using flange couplers 140 to join beams end-to-end. Each beam 40' is fitted with a flange coupler 140 at its end and beams 40' are connected by bolting adjacent flange couplers 140 together. In a preferred embodiment, the flange couplers 140 are welded to the beam 40' ends. Some beams 40' have a flange at one end but other beams 40" (not shown) have flanges at both ends to create longer structures.

While the specification describes particular embodiments of the present invention, those of ordinary skill can devise variations of the present invention without departing from the inventive concept.

The scope of the invention should be limited only by the scope of the claims appended hereto.

What is claimed as new is:

1. Apparatus for coupling movable objects to a fixed structure comprising:

a. A central body having a primary longitudinal first axis about which said central body can rotate, wherein said central body is cylindrical and said first axis is concentric therewith;

b. An axle element inserted through said central body along an axis orthogonal to said first axis;

c. Shackle means attached to said axle element and rotatable about said axle element; and d. Means, including bearing means, connected to said central body coaxial with said first axis and adapted to connect to a support structure;

whereby movable objects coupled to said shackle means can rotate about said orthogonal axes.

* * * * *